US010010132B2

(12) United States Patent
Litvinov

(10) Patent No.: US 10,010,132 B2
(45) Date of Patent: Jul. 3, 2018

(54) VENTILATION OF FOOTWEAR

(71) Applicant: Alexander Litvinov, Brooklyn, NY (US)

(72) Inventor: Alexander Litvinov, Brooklyn, NY (US)

( * ) Notice: Subject to any disclaimer, the term of this patent is extended or adjusted under 35 U.S.C. 154(b) by 25 days.

(21) Appl. No.: 14/596,128

(22) Filed: Jan. 13, 2015

(65) Prior Publication Data

US 2015/0196084 A1 Jul. 16, 2015

Related U.S. Application Data

(60) Provisional application No. 61/964,756, filed on Jan. 13, 2014.

(51) Int. Cl.

*A43B 7/00* (2006.01)
*A43B 7/08* (2006.01)
*A43B 3/00* (2006.01)

(52) U.S. Cl.

CPC ..... *A43B 7/082* (2013.01); *A43B 3/0005* (2013.01); *A43B 3/0015* (2013.01); *A43B 7/005* (2013.01); *A43B 7/081* (2013.01); *A43B 7/085* (2013.01); *A43B 7/087* (2013.01)

(58) Field of Classification Search

CPC .. A43B 7/06; A43B 7/08; A43B 7/081; A43B 7/082; A43B 7/085; A43B 7/087; A43B 3/0005; A43B 3/0015

See application file for complete search history.

(56) References Cited

U.S. PATENT DOCUMENTS 3,048,931 A * 8/1962 Farinello ..... A43B 7/06 36/3 R
3,273,264 A * 9/1966 Farinello, Jr. ..... A43B 3/0005 36/3 A
5,375,345 A * 12/1994 Djuric ..... A43B 3/00 36/3 B
5,460,012 A * 10/1995 Kwok ..... F25D 29/001 165/46
5,611,621 A * 3/1997 Chien ..... A43B 1/0036 36/136

(Continued)

FOREIGN PATENT DOCUMENTS

KR 20090129149 A * 12/2009

*Primary Examiner* — Khoa Huynh
*Assistant Examiner* — Jocelyn Bravo
(74) *Attorney, Agent, or Firm* — Ash Tankha; Lipton, Weinberger & Husick

(57) ABSTRACT

A ventilation apparatus including a pump, a switching unit, and a fluid diffuser is provided. The pump attached to the footwear pumps fluid into and exhausts fluid from a cavity of the footwear. The switching unit in communication with the pump selectively changes modes of operation of the pump. The fluid diffuser connected to the pump within the cavity of the footwear includes a feed pipe for transferring the fluid pumped from the pump to the cavity of the footwear during a pump mode of operation and to transfer the fluid in the cavity of the footwear to an ambient environment external to the footwear during an exhaust mode of operation, for ventilating the footwear. In one or more embodiments, the fluid diffuser includes a diffusing member with one or more openings and/or a fluid distribution channel member for transferring the fluid to and from the cavity of the footwear.

14 Claims, 13 Drawing Sheets

(56) References Cited

U.S. PATENT DOCUMENTS

| | | | | |
|---|---|---|---|---|
| 5,819,438 | A * | 10/1998 | Wanniarachchi | A43B 7/06 36/3 A |
| 5,865,523 | A * | 2/1999 | Chien | A43B 1/0036 36/137 |
| 6,477,789 | B2 | 11/2002 | Cheng | |
| 7,269,915 | B2 * | 9/2007 | Flechsig | A43B 7/081 36/114 |
| 9,107,468 | B1 * | 8/2015 | Xiong | A43B 7/02 |
| 2003/0145488 | A1 * | 8/2003 | Cardarelli | A43B 3/0078 36/3 R |
| 2003/0188451 | A1 | 10/2003 | Wu | |
| 2012/0198729 | A1 | 8/2012 | Graziani et al. | |
| 2013/0019503 | A1 * | 1/2013 | Vogt | A43B 3/0005 36/103 |

* cited by examiner

VENTILATION OF FOOTWEAR

CROSS REFERENCE TO RELATED APPLICATIONS

This application claims priority to and the benefit of provisional patent application No. 61/964,756 titled "Method of mechanical ventilation of shoes", filed in the United States Patent and Trademark Office on Jan. 13, 2014. The specification of the above referenced patent application is incorporated herein by reference in its entirety.

BACKGROUND

When a person wears a proper fitting shoe, there is typically a minimal gap between an inner surface of the shoe and the surface of the person's foot inserted in the shoe. If there is no ventilation inside the shoe and when ambient temperature is high, or when the person performs physical activities, for example, working, walking, running, exercising, etc., the air around the person's foot in the shoe becomes warm and quickly fills with water vapor which creates an uncomfortable environment at the person's foot inside the shoe. A closed shoe has minimal air exchange or ventilation at the front end of the shoe. Therefore, there is a need for removal of air from the shoe, especially from the front end and other parts of the shoe to improve comfort, hygiene, and foot adhesion inside the shoe.

Conventional methods for ventilating shoes typically provide ventilation holes on the shoe surface, or an arrangement of pistons to eject air out of the shoe. However, these methods actively function only when a person walks while wearing the shoe. Moreover, adding ventilation holes in the shoe changes the shoe design, which may not be aesthetically appealing, Furthermore, ventilating shoes by using pistons requires incorporation of bulky and ineffective additional parts into the shoe design.

Hence, there is a long felt but unresolved need for a method and an apparatus for ventilating footwear, for example, shoes, at different times, for example, during rest, during movement, during any physical activity, during high temperature situations, while staying in a hot air environment, or at selected times.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The method and ventilation apparatus disclosed herein addresses the above stated need for ventilating footwear at different times, for example, during rest, during movement, during any physical activity, during high temperature situations, while staying in a hot air environment, or at selected times. The ventilation apparatus disclosed herein comprises a pump, a switching unit, and a fluid diffuser. The pump is fixedly attached on a predefined section, for example, an upper section of the footwear. The pump pumps fluid, for example, air into and exhausts the fluid, for example, air and water vapor from a cavity of the footwear. The switching unit is in electrical communication with the pump. The switching unit selectively changes modes of operation of the pump. The modes of operation comprise, for example, a pump mode for pumping the fluid into the cavity of the footwear, an exhaust mode for exhausting the fluid from the cavity of the footwear, and a termination mode for terminating the operation of the pump.

The fluid diffuser is operably connected to the pump within the cavity of the footwear. In an embodiment, the fluid diffuser comprises a feed pipe. The feed pipe is fixedly connected to and extends from the pump into the cavity of the footwear. The feed pipe transfers the fluid pumped from the pump to the cavity of the footwear during the pump mode and transfers the fluid in the cavity of the footwear to an ambient environment external to the footwear during the exhaust mode, for ventilating the footwear. In another embodiment, the fluid diffuser further comprises a diffusing member that is in fluid communication with the feed pipe. The diffusing member is positioned and attached proximal to a front end of the footwear in the cavity of the footwear. The diffusing member comprises one or more openings for allowing the fluid pumped from the pump through the feed pipe to be transferred into the cavity of the footwear during the pump mode, and to allow the fluid in the cavity of the footwear to be transferred through the feed pipe to an ambient environment external to the footwear during the exhaust mode, for ventilating the footwear.

In another embodiment, the fluid diffuser further comprises a fluid distribution channel member fixedly attached within a sole of the footwear. The fluid distribution channel member comprises channels configured to be in fluid communication with the feed pipe of the fluid diffuser to allow the fluid received from the feed pipe to be transferred to the cavity of the footwear during the pump mode and to allow the fluid in the cavity of the footwear to be transferred through the feed pipe to the ambient environment external to the footwear during the exhaust mode, for ventilating the footwear. In another embodiment, the ventilation apparatus disclosed herein further comprises through holes configured on an insole of the footwear. The through holes of the insole are axially aligned with the channels of the fluid distribution channel member to allow transfer of the fluid received by the channels of the fluid distribution channel member from the feed pipe to the cavity of the footwear during the pump mode and to allow transfer of the fluid from the cavity of the footwear, through the channels of the distribution channel member, into the feed pipe, and out to the ambient environment external to the footwear during the exhaust mode.

In another embodiment, the ventilation apparatus disclosed herein comprises two pumps, that is, a first pump fixedly attached on a predefined section, for example, the upper section of the footwear, and a second pump positioned within a sole of the footwear. The pumps pump fluid into and exhaust the fluid from the cavity of the footwear. The switching unit is in electrical communication with the first pump and the second pump. In this embodiment, the switching unit selectively changes modes of operation of the first pump and the second pump. The modes of operation comprise, for example, a pump mode, an exhaust mode, and a termination mode. In this embodiment, the feed pipe of the fluid diffuser is fixedly connected to and extends from the first pump into the cavity of the footwear. The feed pipe transfers the fluid pumped from the first pump to the diffusing member that is in fluid communication with the feed pipe. The openings of the diffusing member allow the fluid pumped from the first pump through the feed pipe to be transferred into the cavity of the footwear proximal to the front end of the footwear for ventilating the footwear. The openings of the diffusing member further allow the fluid in the cavity of the footwear at the rear end of the footwear to be transferred via the second pump and through the feed pipe to an ambient environment external to the footwear for ventilating the footwear.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
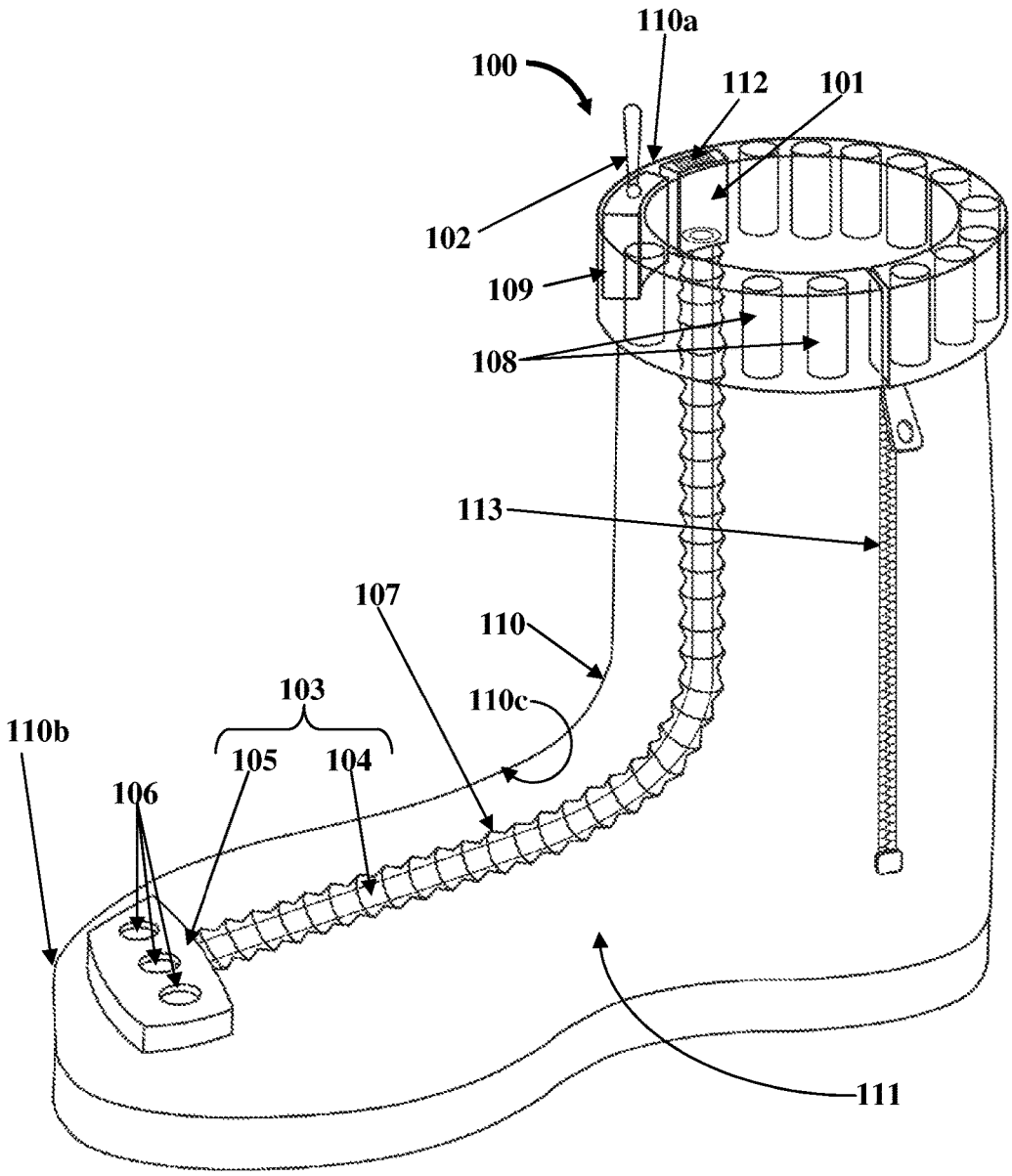
FIG. 1 exemplarily illustrates a right side perspective view of a ventilation apparatus for ventilating footwear.

FIG. 1 exemplarily illustrates a right side perspective view of a ventilation apparatus 100 for ventilating footwear 110, for example, shoes, sneakers, boots, high boots, etc. The ventilation apparatus 100 disclosed herein is a mechanical ventilation unit comprising a pump 101, a switching unit 102, and a fluid diffuser 103. The pump 101 is fixedly attached on a predefined section, for example, an upper section 110*a* of the footwear 110. The pump 101 is, for example, a piezoelectric pump, an electromechanical pump, etc. The pump 101 can be of any predefined size or shape and can be positioned on any section inside or outside the footwear 110. The pump 101 pumps fluid 201 into and exhausts fluid 201 from a cavity 111 of the footwear 110 as exemplarily illustrated in FIGS. 2-3. As used herein, the term "fluid" refers to a substance, as a liquid or a gas, capable of flowing. The fluid 201 pumped into or exhausted out from the cavity 111 of the footwear 110 comprises, for example, air, water vapor, etc. Also, as used herein, the term "cavity" refers to an interior space defined by the footwear 110 where a foot of a user is inserted. The switching unit 102 is in electrical communication with the pump 101. The switching unit 102 selectively changes modes of operation of the pump 101. The modes of operation comprise, for example, a pump mode for pumping the fluid 201 into the cavity 111 of the footwear 110, and an exhaust mode for exhausting the fluid 201 from the cavity 111 of the footwear 110. In an embodiment, the modes of operation of the pump 101 further comprise a termination mode for terminating the operation of the pump 101. The switching unit 102 can therefore be a two way switch or a three way switch depending on the number of modes of operation. The switching unit 102 enables actuation of the pump 101 at different times, for example, during rest, during movement, during any physical activity, during high temperature situations, while staying in a hot air environment, or at selected times for ventilating the footwear 110.

The fluid diffuser 103 is operably connected to the pump 101 within the cavity 111 of the footwear 110. The fluid diffuser 103 comprises a feed pipe 104 fixedly connected to and extending from the pump 101 into the cavity 111 of the footwear 110. The feed pipe 104 transfers the fluid 201 pumped from the pump 101 to the cavity 111 of the footwear 110 during the pump mode. The feed pipe 104 further transfers the fluid 201 in the cavity 111 of the footwear 110 to an ambient environment external to the footwear 110 during the exhaust mode, for ventilating the footwear 110.

In an embodiment as exemplarily illustrated in FIG. 1, the fluid diffuser 103 further comprises a diffusing member 105 in fluid communication with the feed pipe 104. The feed pipe 104 is, for example, a short fitting pipe member that provides an air tight connection between the pump 101 and the diffusing member 105. The diffusing member 105 is positioned and attached proximal to a front end 110*b* of the footwear 110 in the cavity 111 of the footwear 110. The diffusing member 105 comprising one or more openings 106 for allowing the fluid 201 pumped from the pump 101 through the feed pipe 104 to be transferred into the cavity 111 of the footwear 110 during the pump mode for ventilating the footwear 110. Further, the openings 106 of the diffusing member 105 allow the fluid 201 in the cavity 111 of the footwear 110 to be transferred through the feed pipe 104 to an ambient environment external to the footwear 110, via vents 112 configured on the pump 101, during the exhaust mode for ventilating the footwear 110. The feed pipe 104 and the diffusing member 105 are made, for example, of synthetic materials with elastic properties. In an embodiment, the fluid diffuser 103 further comprises a metallic tube 107 configured as a hose to enclose and secure the feed pipe 104. The feed pipe 104 is enclosed within the metallic tube 107. The metallic tube 107 provides protection against crumpling of the feed pipe 104. The metallic tube 107 with the enclosed feed pipe 104 is positioned in recesses proximal to an inner surface 110*c* of the footwear 110.

The ventilation apparatus 100 disclosed herein further comprises one or more energy storage devices 108, for example, batteries positioned proximal to the predefined section, for example, the upper section 110*a* of the footwear 110. The energy storage devices 108 are operably connected to the pump 101. The energy storage devices 108 supply electrical energy to the pump 101 to actuate the pump 101. In an embodiment, the ventilation apparatus 100 disclosed herein further comprises an energy converter 109, for example, an electric current converter, in electrical communication with the energy storage devices 108 and the pump 101. The energy converter 109 converts direct current received from the energy storage devices 108 to an alternating current to be supplied to the pump 101 to actuate the pump 101. In an embodiment, the energy storage devices 108 supply a direct current to the pump 101 to actuate the pump 101. In an embodiment, the pump 101, the energy storage devices 108, and the energy converter 109 are positioned within a horseshoe shaped upper section 110*a* of the footwear 110 as exemplarily illustrated in FIG. 1. In an embodiment, the pump 101, the energy storage devices 108, and the energy converter 109 can be positioned at any convenient location inside or outside the footwear 110. A zipper 113 is fixedly attached to the footwear 110 to allow the user to access the cavity 111 of the footwear 110 and insert the foot into the cavity 111 of the footwear 110.

Figure 2:
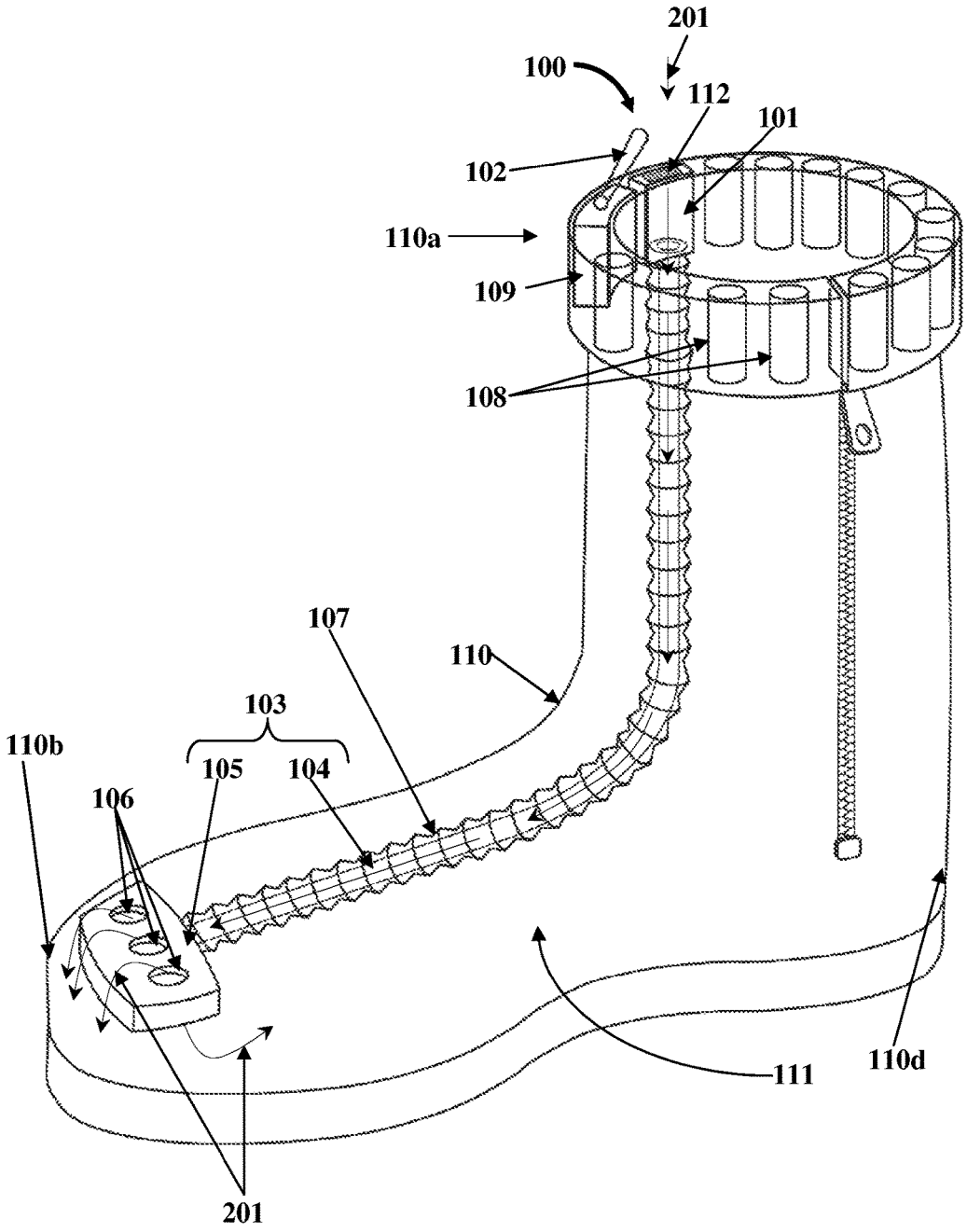
FIG. 2 exemplarily illustrates a right side perspective view of the ventilation apparatus, showing a pump mode of operation of the ventilation apparatus.

FIG. 2 exemplarily illustrates a right side perspective view of the ventilation apparatus 100, showing a pump mode of operation of the ventilation apparatus 100. The switching unit 102 of the ventilation apparatus 100 is, for example, a three way switch for triggering the pump mode, the exhaust mode, and the termination mode of the pump 101. The pump 101 is elastically suspended at the upper section 110*a* of the footwear 110 and forms a rigid connection with the feed pipe 104 of the fluid diffuser 103. The pump 101 is used to pump or suction fluid 201 in and out of the footwear 110 respectively, and is connected to the fluid diffuser 103 that transports fluid 201 in and out of the cavity 111 of the footwear 110. To reverse the direction of rotation of a motor (not shown) of the pump 101, the pump 101 is energized through the switching unit 102, for example, the three way switch, which has an intermediate neutral position corresponding to the termination mode of the pump 101. The alternative positions of the switching unit 102 correspond to alternative directions of rotation of the motor of the pump 101.

The arrows shown in FIG. 2 indicate the direction of flow of the fluid 201 from the ambient environment into the cavity 111 of the footwear 110. Initially, on activation by the user, the switching unit 102 switches the pump 101 from the neutral position, that is, the termination mode to the pump mode. In the pump mode, the pump 101 pumps fluid 201 from the ambient environment external to the footwear 110 via the vents 112, and then into the cavity 111 of the footwear 110 via the fluid diffuser 103. The pumped fluid 201 from the pump 101 is transferred to the feed pipe 104, from where the pumped fluid 201 is further transferred to the diffusing member 105 that is distally connected to the feed pipe 104. In an embodiment, the diffusing member 105 is configured as a fluid dispersing pipe. The diffusing member 105 can be any type of diffuser, for example, the type of diffuser pipe through which air is bubbled into the water in aquariums. The fluid 201 received from the feed pipe 104 is transferred through the openings 106 of the diffusing member 105 into the cavity 111 of the footwear 110, for example, towards the front end 110*b* and towards the rear end 110*d* of the footwear 110. The pumped fluid 201 is therefore circulated around the foot of a user wearing the footwear 110, thereby providing cooling around the foot of the user. The switching unit 102 can be turned on or off at any time, for example, when the user wears the footwear 110 for a long duration, when the user wearing the footwear 110 stays in a warm air environment, when the user wearing the footwear 110 exercises, etc. The movements of the foot of the user inside the footwear 110, for example, during working, walking, running, etc., further adds to the intermixing of warm fluid and the incoming pumped fluid 201 from the pump 101. On activation by the user, the switching unit 102 can then switch from the pump mode to the exhaust mode to exhaust the fluid 201 from the cavity 111 of the footwear 110 as disclosed in the detailed description of FIG. 3.

Figure 3:
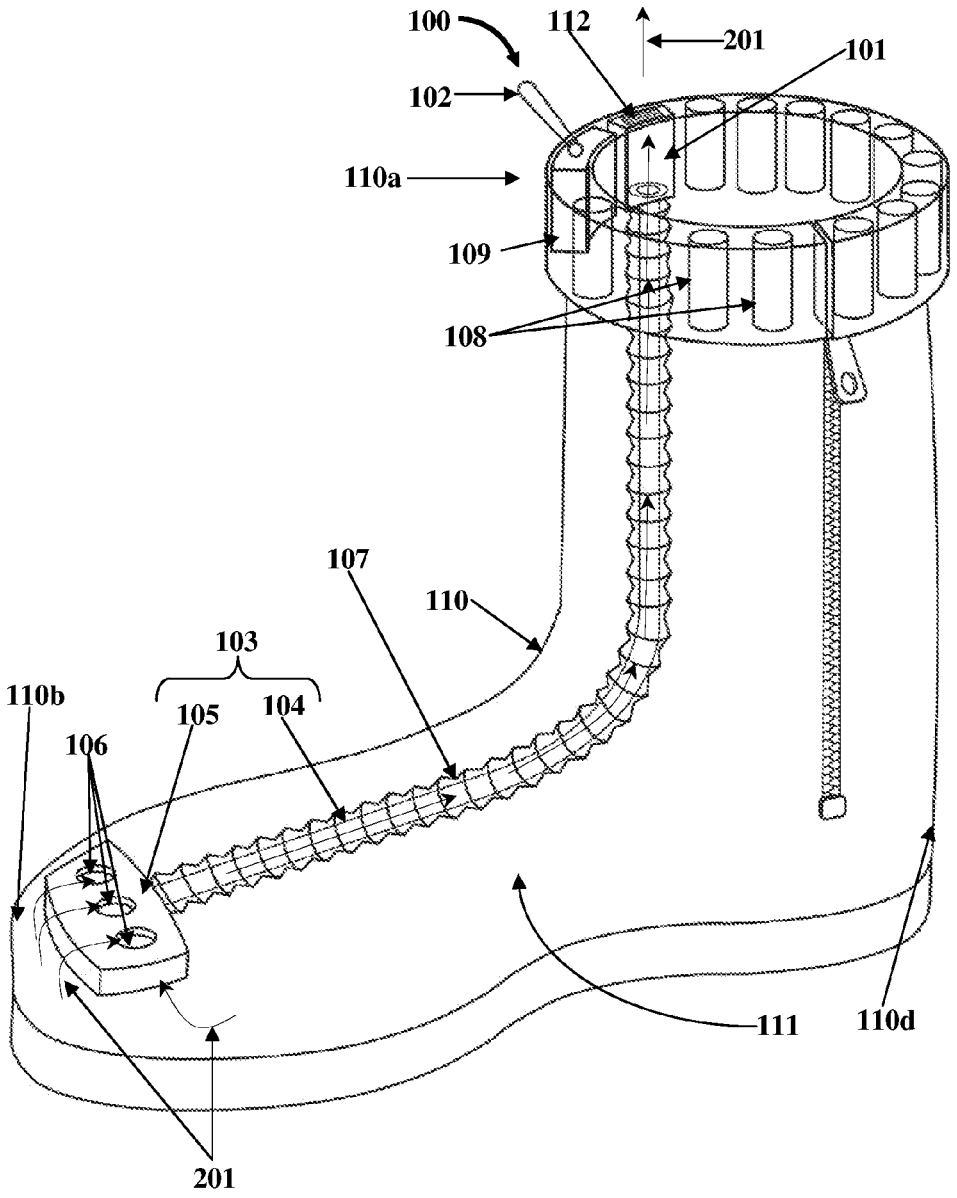
FIG. 3 exemplarily illustrates a right side perspective view of the ventilation apparatus, showing an exhaust mode of operation of the ventilation apparatus.

FIG. 3 exemplarily illustrates a right side perspective view of the ventilation apparatus 100, showing an exhaust mode of operation of the ventilation apparatus 100. The arrows shown in FIG. 3 indicate the direction of flow of the fluid 201 from the cavity 111 of the footwear 110 to the ambient environment. After the pump mode, the pump 101 is switched to the exhaust mode by reversing polarity of the supplied voltage from the energy storage devices 108 via the switching unit 102, or by changing the direction of rotation of the motor (not shown) of the pump 101, that is, by mechanical turning of the motor of the pump 101 between input and output connections of the motor. The pump 101 exhausts fluid 201 from the cavity 111 of the footwear 110 through the fluid diffuser 103. When the pump 101 is switched to the exhaust mode, exhaust fluid 201 from the cavity 111 of the footwear 110 is directed through the openings 106 of the diffusing member 105 of the fluid diffuser 103 and into the feed pipe 104, and then exhausted through the pump 101. The pump 101 exhausts the fluid 201 into the ambient environment external to the footwear 110 via the vents 112. The exhaust mode of operation of the pump 101 ventilates the footwear 110 by exhausting the warm fluid 201 around the foot of a user wearing the footwear 110, thereby providing cooling around the foot of the user.

Figure 4:
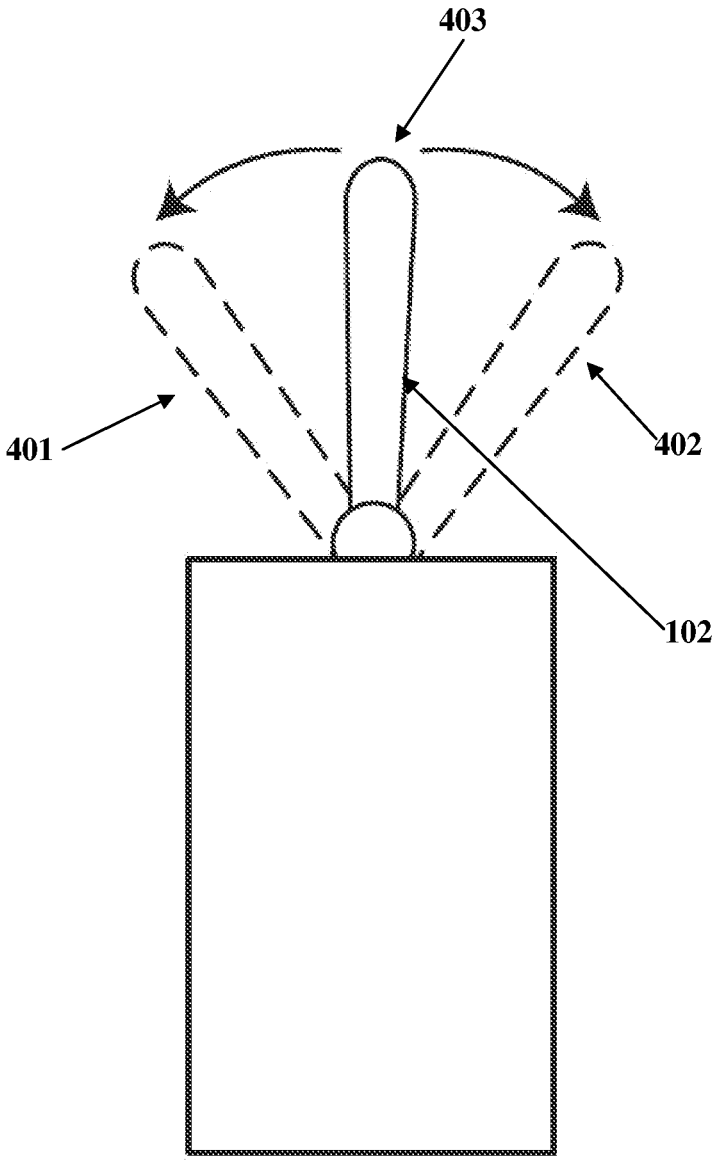
FIG. 4 exemplarily illustrates a front elevation view of a switching unit of the ventilation apparatus, showing the operation of the switching unit.

FIG. 4 exemplarily illustrates a front elevation view of the switching unit 102 of the ventilation apparatus 100 exemplarily illustrated in FIG. 1, showing the operation of the switching unit 102. The switching unit 102 selectively changes modes of operation, for example, the pump mode, the exhaust mode, and the termination mode of the pump 101 exemplarily illustrated in FIG. 1. The pump mode for pumping the fluid 201 exemplarily illustrated in FIG. 2, into the cavity 111 of the footwear 110 is activated when the switching unit 102 is moved to a first position 401. The exhaust mode for exhausting the fluid 201 exemplarily illustrated in FIG. 3, from the cavity 111 of the footwear 110 is activated when the switching unit 102 is moved to a second position 402. The position 403 of the switching unit 102 exemplarily illustrated in FIG. 4, shows the termination mode of the pump 101.

Figure 5:
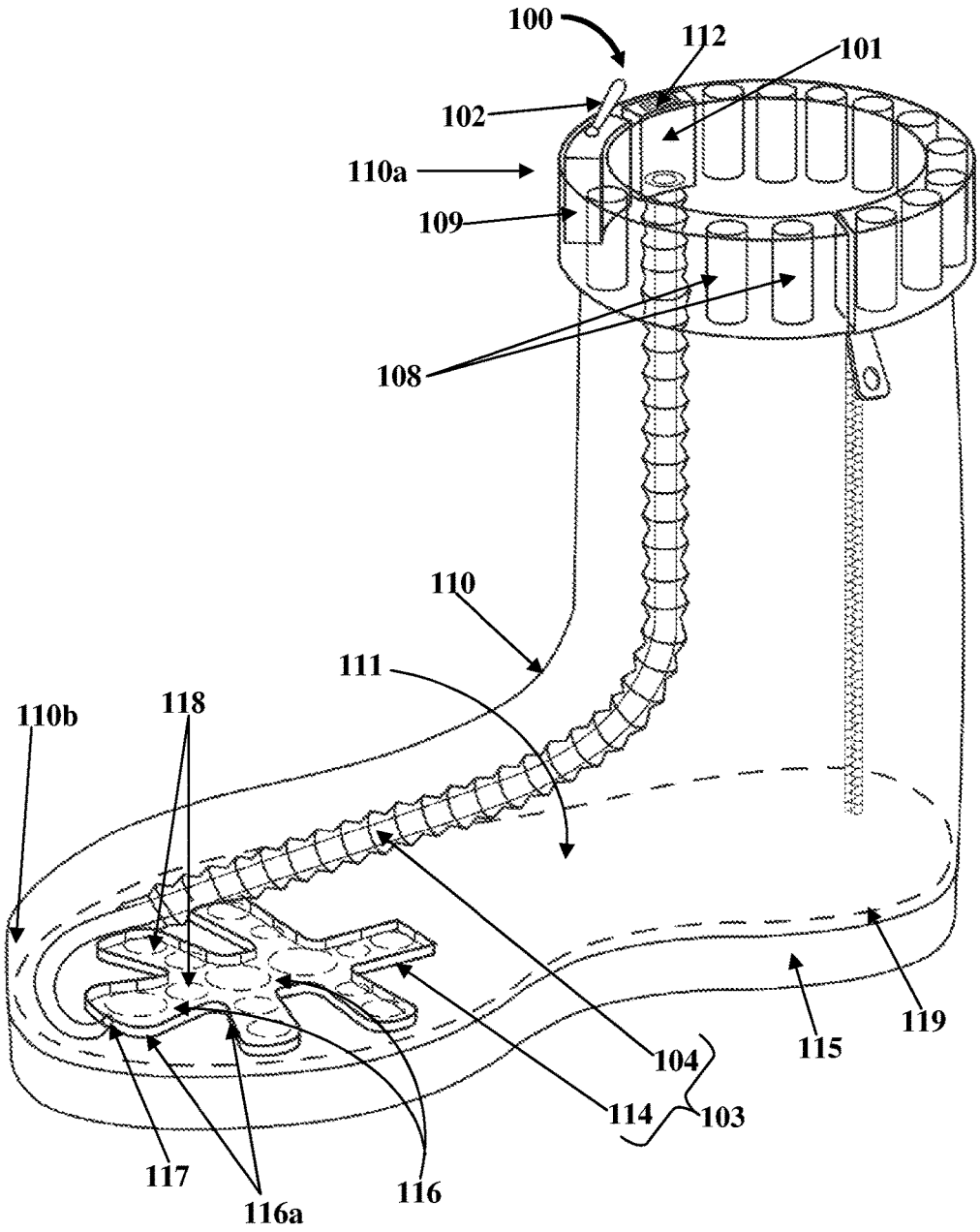
FIG. 5 exemplarily illustrates an embodiment of the ventilation apparatus for ventilating footwear.

FIG. 5 exemplarily illustrates an embodiment of the ventilation apparatus 100 for ventilating footwear 110. The ventilation apparatus 100 comprises the pump 101, the switching unit 102, the energy storage units 108, and the energy converter 109 positioned, for example, on the upper section 110*a* of the footwear 110 as disclosed in the detailed description of FIG. 1. In an embodiment, in addition to the feed pipe 104, the fluid diffuser 103 of the ventilation apparatus 100 further comprises a fluid distribution channel member 114 fixedly attached within a sole 115 of the footwear 110. The fluid distribution channel member 114 comprises channels 116 configured to be in fluid communication with the feed pipe 104 of the fluid diffuser 103 to allow the fluid 201 received from the feed pipe 104 exemplarily illustrated in FIG. 6, to be transferred to the cavity 111 of the footwear 110 during the pump mode and to allow the fluid 201 in the cavity 111 of the footwear 110 to be transferred through the feed pipe 104 to the ambient environment external to the footwear 110 during the exhaust mode, for ventilating the footwear 110. In an embodiment as exemplarily illustrated in FIG. 5, the channels 116 are configured along multiple branches 116*a* of the fluid distribution channel member 114 for enhanced transfer of the fluid 201 to and from the cavity 111 of the footwear 110. The fluid 201 is transferred between the feed pipe 104 and the fluid distribution channel member 114 via a connection opening 117 positioned on the fluid distribution channel member 114.

In an embodiment, through holes 118 are configured on an insole 119 of the footwear 110. The through holes 118 of the insole 119 are axially aligned with the channels 116 of the fluid distribution channel member 114 to allow the transfer of the fluid 201 received by the channels 116 of the fluid distribution channel member 114 from the feed pipe 104 to the cavity 111 of the footwear 110 during the pump mode and to allow transfer of the fluid 201 from the cavity 111 of the footwear 110, through the channels 116 of the fluid distribution channel member 114, into the feed pipe 104, and out to the ambient environment external to the footwear 110 during the exhaust mode.

Figure 6:
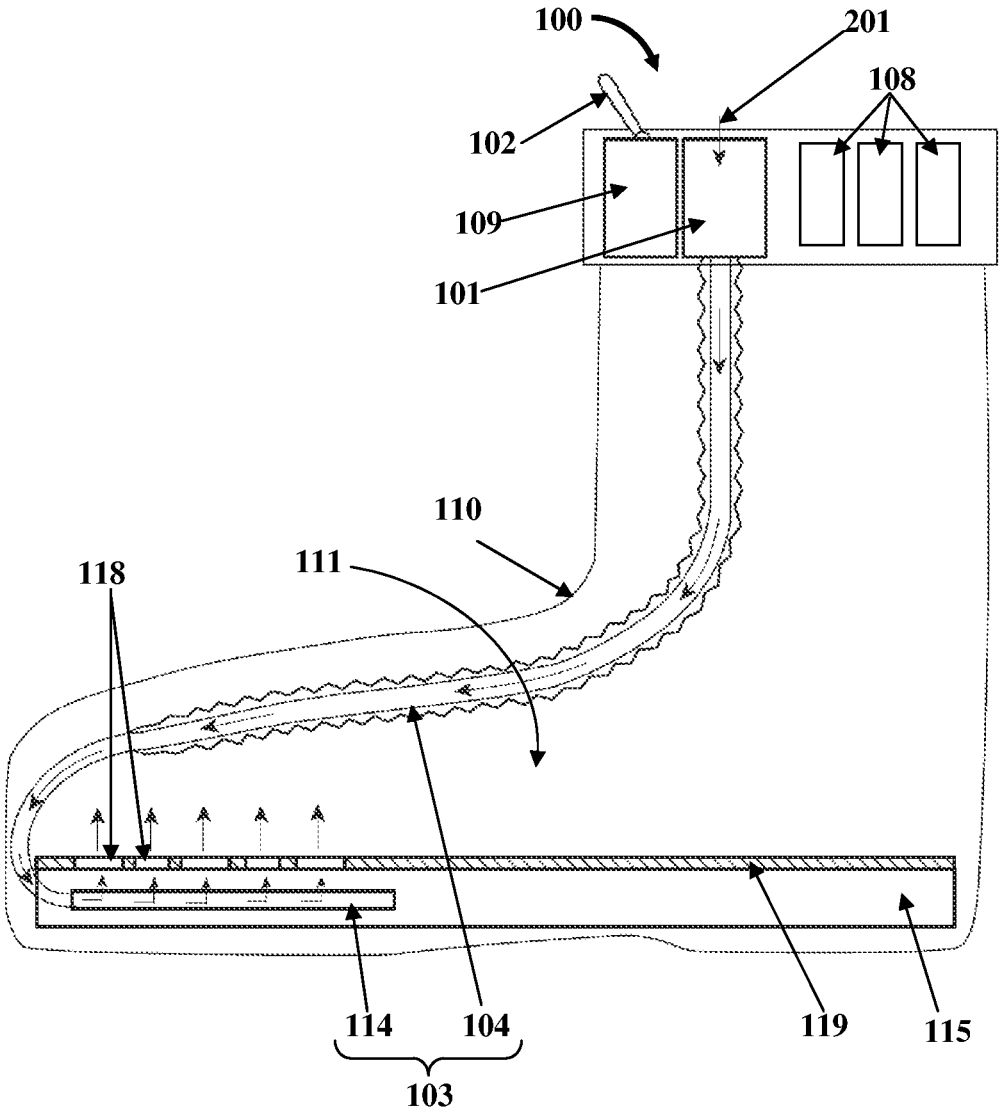
FIG. 6 exemplarily illustrates a right side elevation view of the embodiment of the ventilation apparatus shown in FIG. 5, showing a pump mode of operation of the ventilation apparatus.

FIG. 6 exemplarily illustrates a right side elevation view of the embodiment of the ventilation apparatus 100 shown in FIG. 5, showing a pump mode of operation of the ventilation apparatus 100. As exemplarily illustrated in FIG. 6, when a user wants to pump fluid 201 into the cavity 111 of the footwear 110 to ventilate the footwear 110, the user switches the pump 101 to the pump mode using the switching unit 102. In the pump mode, the pump 101 starts pumping the fluid 201 from the ambient environment external to the footwear 110 through the vents 112 exemplarily illustrated in FIG. 5, and through the feed pipe 104, which is connected to the fluid distribution channel member 114 through the connection opening 117. The fluid 201 from the feed pipe 104 enters the channels 116 of the fluid distribution channel member 114 through the connection opening 117 exemplarily illustrated in FIG. 5. The fluid 201 is then transferred from the channels 116 of the fluid distribution channel member 114 to the cavity 111 of the footwear 110 through the through holes 118 of the insole 119.

Figure 7:
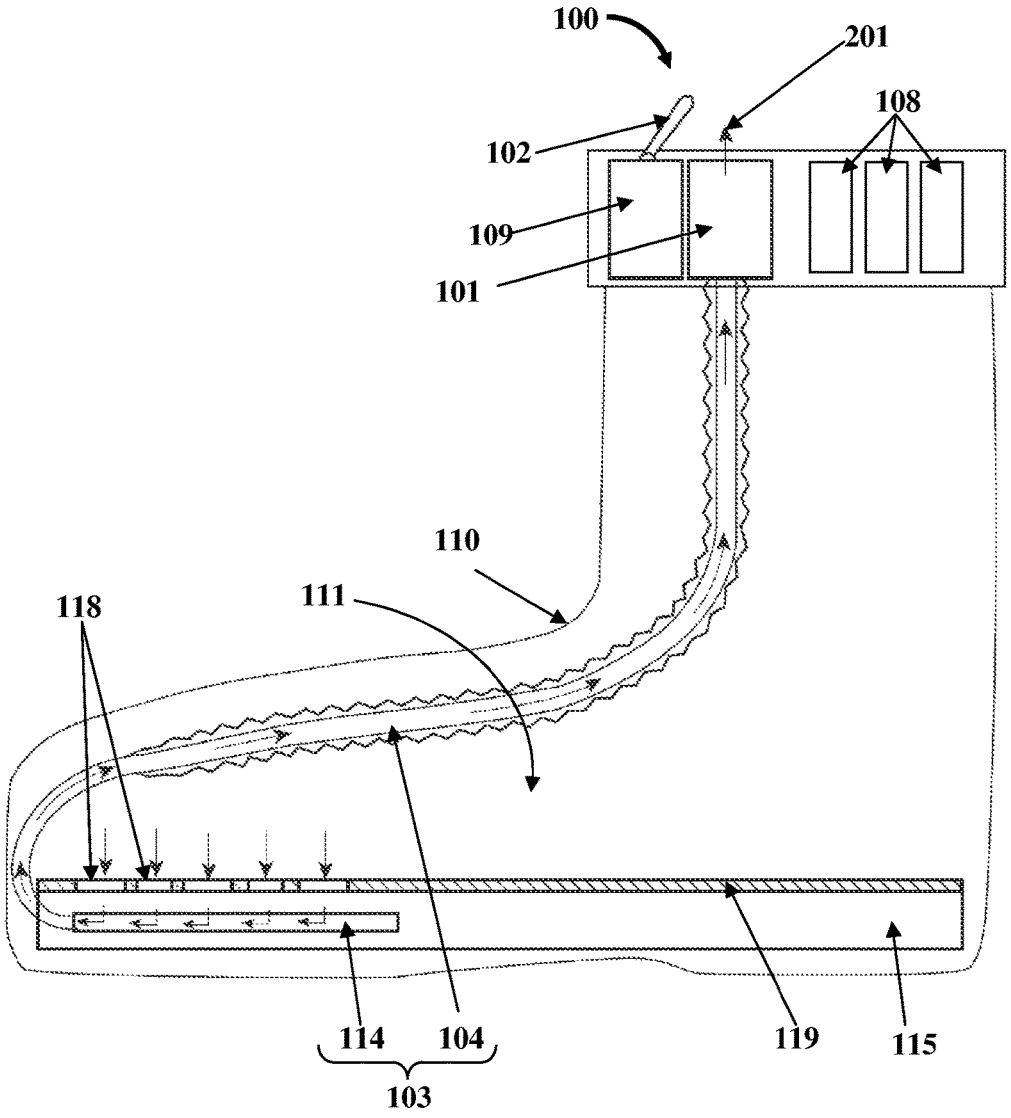
FIG. 7 exemplarily illustrates a right side elevation view of the embodiment of the ventilation apparatus shown in FIG. 5, showing an exhaust mode of operation of the ventilation apparatus.

FIG. 7 exemplarily illustrates a right side elevation view of the embodiment of the ventilation apparatus 100 shown in FIG. 5, showing an exhaust mode of operation of the ventilation apparatus 110. As exemplarily illustrated in FIG. 7, when a user wants to exhaust fluid 201 from the cavity 111 of the footwear 110, the user switches the pump 101 to the exhaust mode using the switching unit 102. In the exhaust mode, the pump 101 suctions or exhausts the fluid 201 from inside the cavity 111 of the footwear 110 to the ambient environment external to the footwear 110. The fluid 201 from the cavity 111 of the footwear 110 is first transferred through the through holes 118 of the insole 119 and into the channels 116 of the fluid distribution channel member 114 positioned inside the sole 115 below the insole 119 as exemplarily illustrated in FIG. 5. The fluid 201 is then transferred from the channels 116 of the fluid distribution channel member 114 to the feed pipe 104. The feed pipe 104 then transfers the fluid 201 out to the ambient environment external to the footwear 110 through the vents 112 positioned on the pump 101 exemplarily illustrated in FIG. 5.

Figure 8:
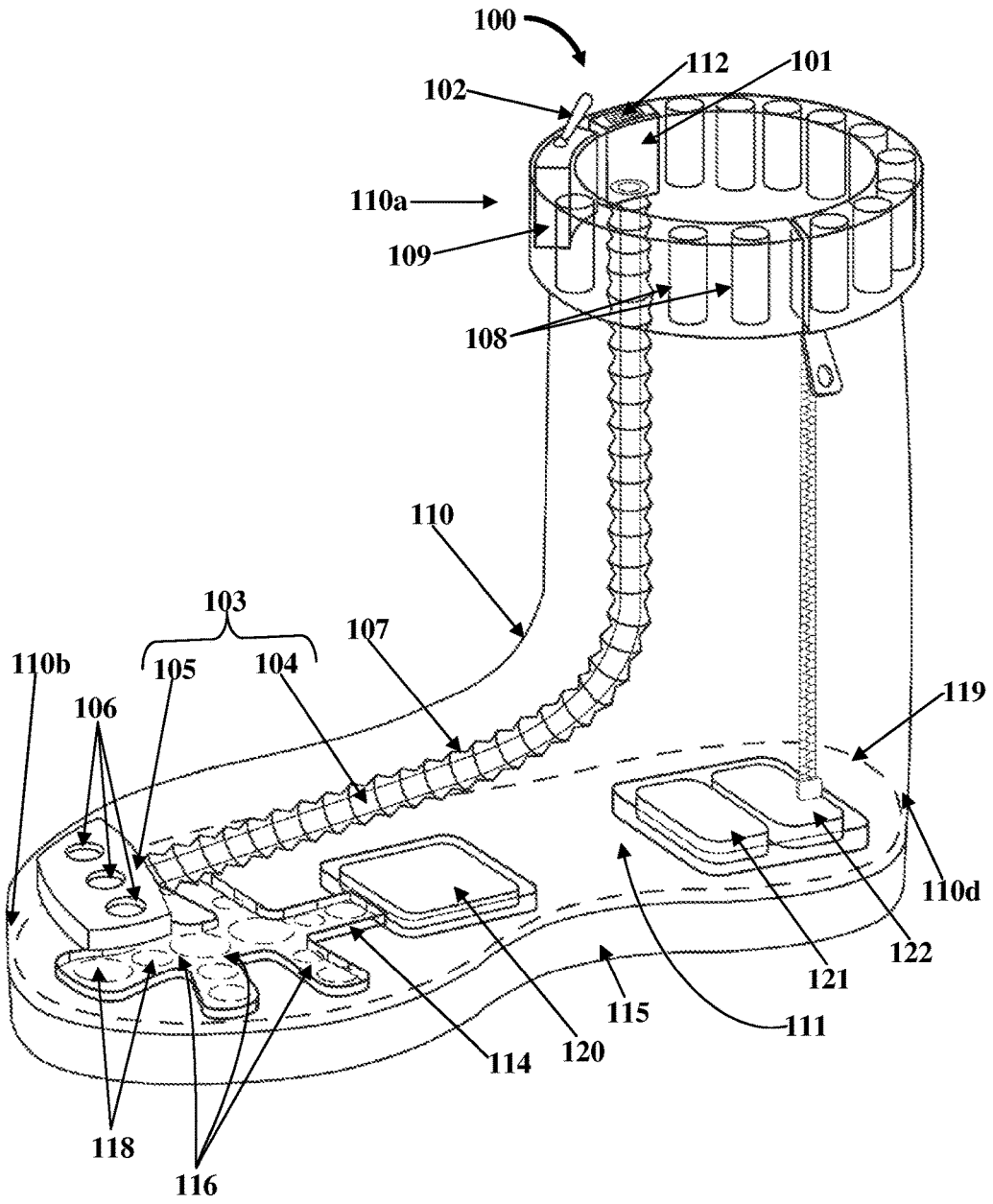
FIG. 8 exemplarily illustrates an embodiment of the ventilation apparatus for ventilating footwear.

FIG. 8 exemplarily illustrates an embodiment of the ventilation apparatus 100 for ventilating footwear 110. In this embodiment, the ventilation apparatus 100 comprises pumps 101 and 120, the switching unit 102, and the fluid diffuser 103. The pumps 101 and 120 comprise a first pump 101 fixedly attached on a predefined section, for example, the upper section 110*a* of the footwear 110, and a second pump 120 positioned within a sole 115 of the footwear 110. The second pump 120 is, for example, centrally positioned on the sole 115 of the footwear 110. The pumps 101 and 120 are, for example, piezoelectric pumps, electromechanical pumps, etc. The pumps 101 and 120 pump fluid 201 into the cavity 111 of the footwear 110 and exhaust the fluid 201 from the cavity 111 of the footwear 110 as exemplarily illustrated in FIGS. 10-11. The switching unit 102 is in electrical communication with the first pump 101 and the second pump 120. The switching unit 102 selectively changes modes of operation of the first pump 101 and the second pump 120. The modes of operation comprise a pump mode and an exhaust mode. In an embodiment, the modes of operation further comprise a termination mode. In an embodiment, the pumps 101 and 120 are interlocked, so that when the switching unit 102 actuates one pump 101 into the exhaust mode or a suction mode, the other pump 120 starts to pump in the pump mode and vice versa. In another embodiment, when the switching unit 102 switches one pump 101 to the pump mode, the other pump 120 also operates in the pump mode, and when the switching unit 102 switches one pump 101 to the exhaust mode or a suction mode, the other pump 120 also operates in the exhaust mode.

The fluid diffuser 103 is operably connected to the first pump 101 and the second pump 120 within the cavity 111 of the footwear 110. In this embodiment, the fluid diffuser 103 comprises the feed pipe 104 and the diffusing member 105. The feed pipe 104 is fixedly connected to and extends from the first pump 101 into the cavity 111 of the footwear 110. The feed pipe 104 transfers the fluid 201 pumped from the first pump 101 to the diffusing member 105 in fluid communication with the feed pipe 104. The diffusing member 105 is positioned and attached proximal to a front end 110*b* of the footwear 110 in the cavity 111 of the footwear 110. The diffusing member 105 comprises one or more openings 106 configured to allow the fluid 201 pumped from the first pump 101 through the feed pipe 104 to be transferred into the cavity 111 of the footwear 110 proximal to the front end 110*b* of the footwear 110, and to allow the fluid 201 in the cavity 111 of the footwear 110 at the rear end 110*d* of the footwear 110 to be transferred via the second pump 120 and through the feed pipe 104 to an ambient environment external to the footwear 110, for ventilating the footwear 110.

In this embodiment, the fluid diffuser 103 further comprises a fluid distribution channel member 114 fixedly attached within the sole 115 of the footwear 110. The fluid distribution channel member 114 is operably connected to and in fluid communication with the second pump 120 within the sole 115 of the footwear 110. The fluid distribution channel member 114 comprises channels 116 configured to be in fluid communication with the openings 106 of the diffusing member 105 to allow the fluid 201 received from the openings 106 of the diffusing member 105 to be transferred to the second pump 120, and to allow the fluid 201 pumped by the second pump 120 to be transferred to the openings 106 of the diffusing member 105, into the feed pipe 104, and out to the ambient environment external to the footwear 110 via the first pump 101, for ventilating the footwear 110. The channels 116 of the fluid distribution channel member 114 allow unobstructed passage of fluid 201, for example, air to and from the second pump 120. Through holes 118 are configured on the insole 119 of the footwear 110 as disclosed in the detailed description of FIG.

9. The ventilation apparatus 100 further comprises an energy storage device 121 and an energy converter 122 as disclosed in the detailed description of FIG. 9.

Figure 9:
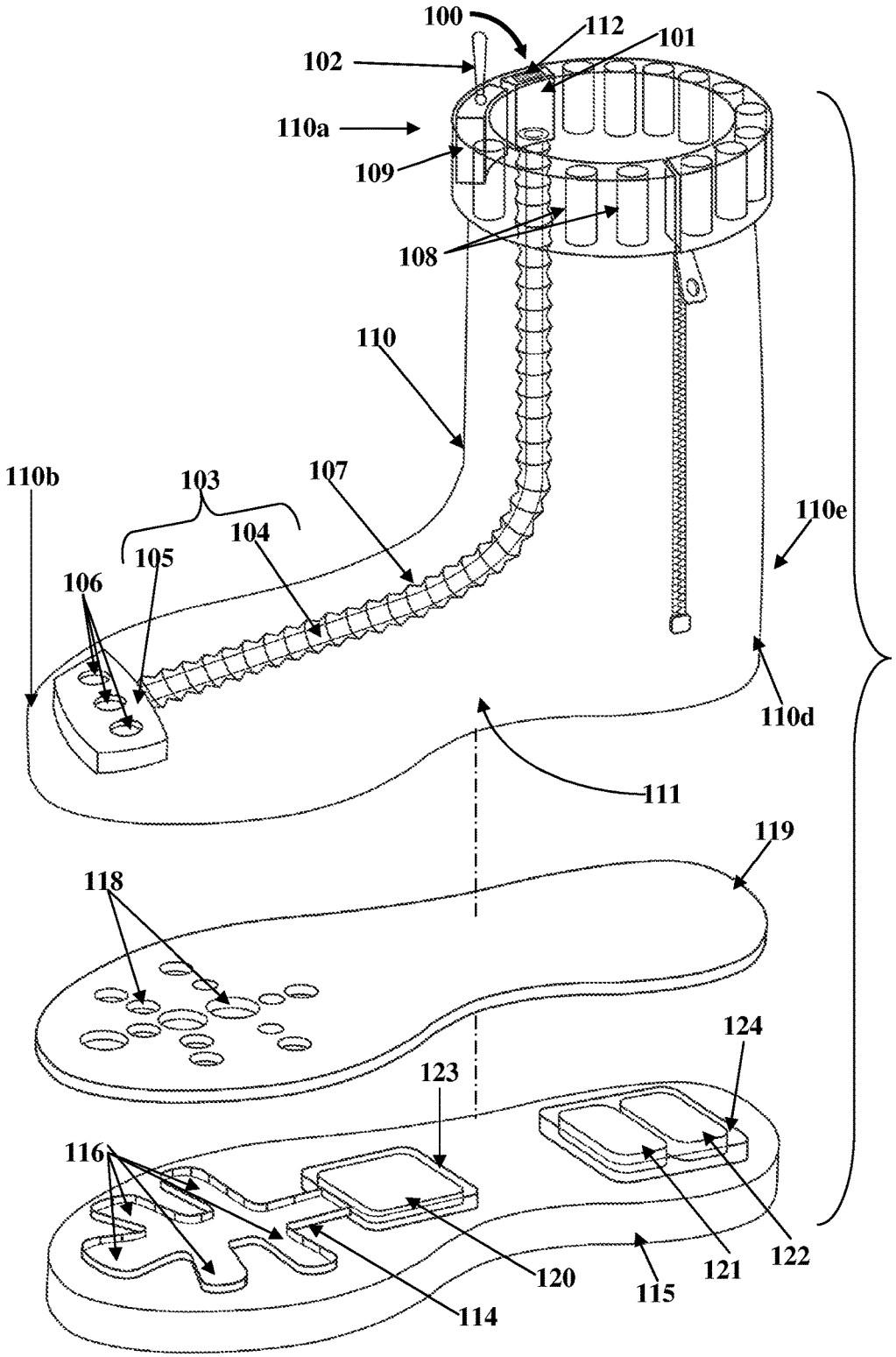
FIG. 9 exemplarily illustrates an exploded view of the embodiment of the ventilation apparatus shown in FIG. 8.

FIG. 9 exemplarily illustrates an exploded view of the embodiment of the ventilation apparatus 100 shown in FIG. 8. The exploded view shows an upper portion 110*e* of the footwear 110, the insole 119 of the footwear 110, and the sole 115 of the footwear 110. As exemplarily illustrated in FIG. 9, the upper portion 110*e* of the footwear 110 accommodates the first pump 101, the switching unit 102, the energy storage devices 108, the energy converter 109, and the feed pipe 104 and the diffusing member 105 of the fluid diffuser 103. The energy storage devices 108, for example, batteries are operably connected to the first pump 101 for supplying electrical energy to the first pump 101 to actuate the first pump 101. The energy converter 109 is in electrical communication with the energy storage devices 108 and the first pump 101. The energy converter 109 converts direct current received from the energy storage devices 108 to an alternating current to be supplied to the first pump 101 to actuate the first pump 101.

The upper portion 110*e* of the footwear 110 is removably attached on the insole 119 of the footwear 110. The insole 119 of the footwear 110 is positioned on the sole 115 of the footwear 110. The sole 115 of the footwear 110 accommodates an encasing 123 that holds the second pump 120, and another encasing 124 that holds an energy storage device 121, for example, a battery, and an energy converter 122. The encasings 123 and 124 are rigid protective frames configured to protect the second pump 120, and the energy storage device 121, and the energy converter 122 respectively. The energy storage device 121 is operably connected to the second pump 120 for supplying electrical energy to the second pump 120 to actuate the second pump 120. The energy converter 122, for example, an electric current converter, is in electrical communication with the energy storage device 121 and the second pump 120. The energy converter 122 converts direct current received from the energy storage device 121 to an alternating current to be supplied to the second pump 120 to actuate the second pump 120. In an embodiment, the energy storage device 121 supplies direct current to the second pump 120 to actuate the second pump 120. The second pump 120, and the energy storage device 121 and the energy converter 122 which are subjected to stress during walking, are mounted inside their respective encasings 123 and 124, which are elastically suspended inside the sole 115 of the footwear 110.

The second pump 120 is operably connected to the fluid distribution channel member 114 within the sole 115 of the footwear 110. In this embodiment, the through holes 118 configured on the insole 119 of the footwear 110 are axially aligned with the channels 116 of the fluid distribution channel member 114 to allow transfer of the fluid 201 received from the openings 106 of the diffusing member 105 to the channels 116 of the fluid distribution channel member 114 for transfer of the fluid 201 to the second pump 120 as exemplarily illustrated in FIG. 10, and to allow the transfer of the fluid 201 pumped by the second pump 120 to the openings 106 of the diffusing member 105 via the channels 116 of the fluid distribution channel member 114, into the feed pipe 104, and out to the ambient environment external to the footwear 110 via the first pump 101 as exemplarily illustrated in FIG. 11.

Figure 10:
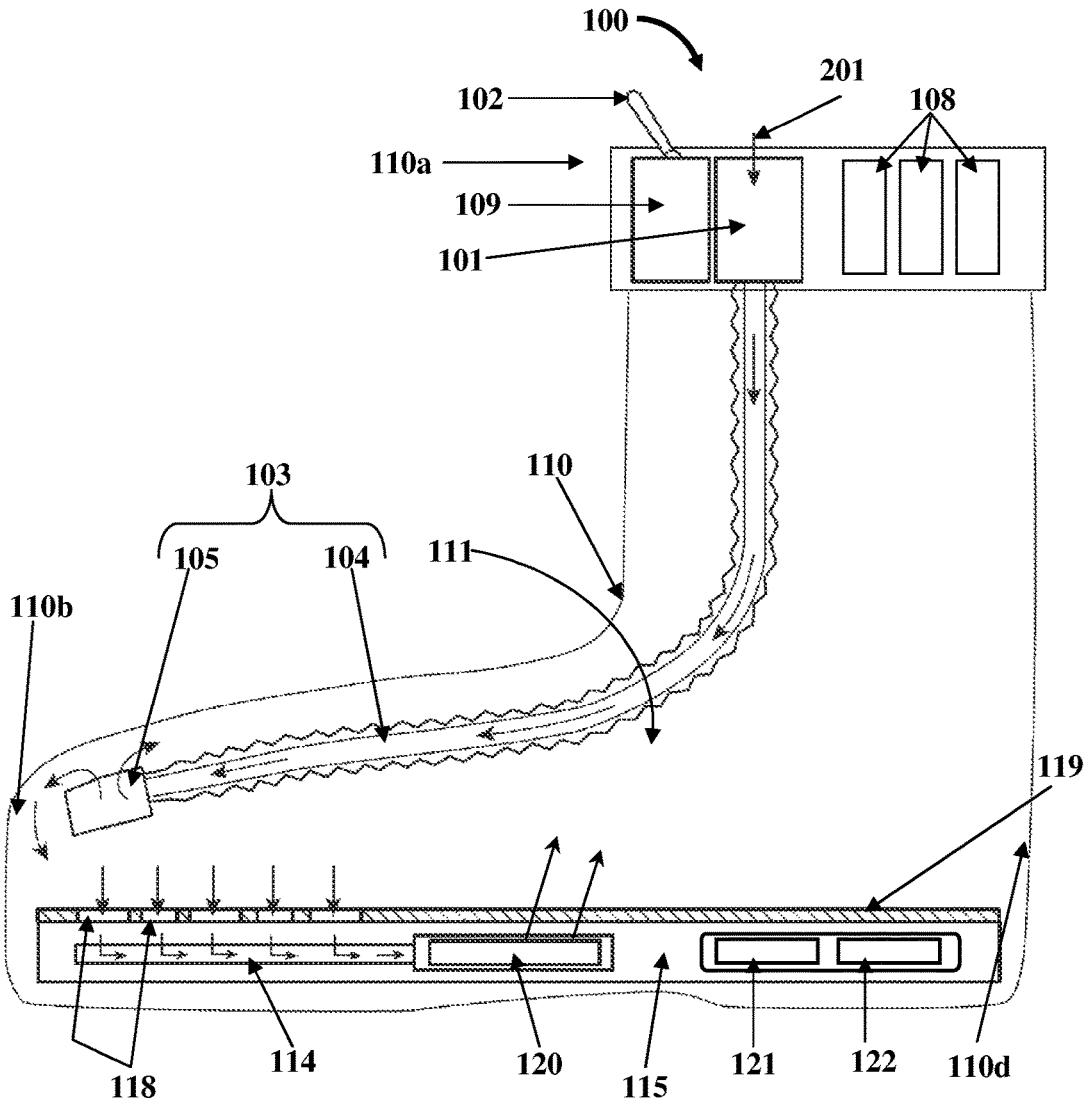
FIG. 10 exemplarily illustrates a right side elevation view of the embodiment of the ventilation apparatus shown in FIG. 8, showing a first pump in a pump mode and a second pump in an exhaust mode.

FIG. 10 exemplarily illustrates a right side elevation view of the embodiment of the ventilation apparatus 100 shown in FIG. 8, showing the first pump 101 in a pump mode and the second pump 120 in an exhaust mode. In an example, when the user wants to ventilate the cavity 111 of the footwear 110 by pumping fluid 201 into the cavity 111 of the footwear 110, the user activates the switching unit 102 to switch the first pump 101 to the pump mode and the second pump 120 to the exhaust mode. In the pump mode, the first pump 101 pumps fluid 201, for example, air from the ambient environment external to the footwear 110, into the cavity 111 of the footwear 110 through the fluid diffuser 103. The fluid 201 pumped from the first pump 101 is transferred to the diffusing member 105 of the fluid diffuser 103 through the feed pipe 104 of the fluid diffuser 103. The fluid 201 is then transferred to the cavity 111 proximal to the front end 110*b* of the footwear 110 through the openings 106 of the diffusing member 105. In the exhaust mode, the second pump 120 suctions a portion of the fluid 201 from the front end 110*b* of the footwear 110 and transfers said portion of the fluid 201 to the rear end 110*d* of the footwear 110. The fluid 201 is suctioned and transferred from the cavity 111 proximal to the front end 110*b* of the footwear 110 to the second pump 120 via the through holes 118 on the insole 119 and the channels 116 of the fluid distribution channel member 114 exemplarily illustrated in FIGS. 8-9.

Figure 11:
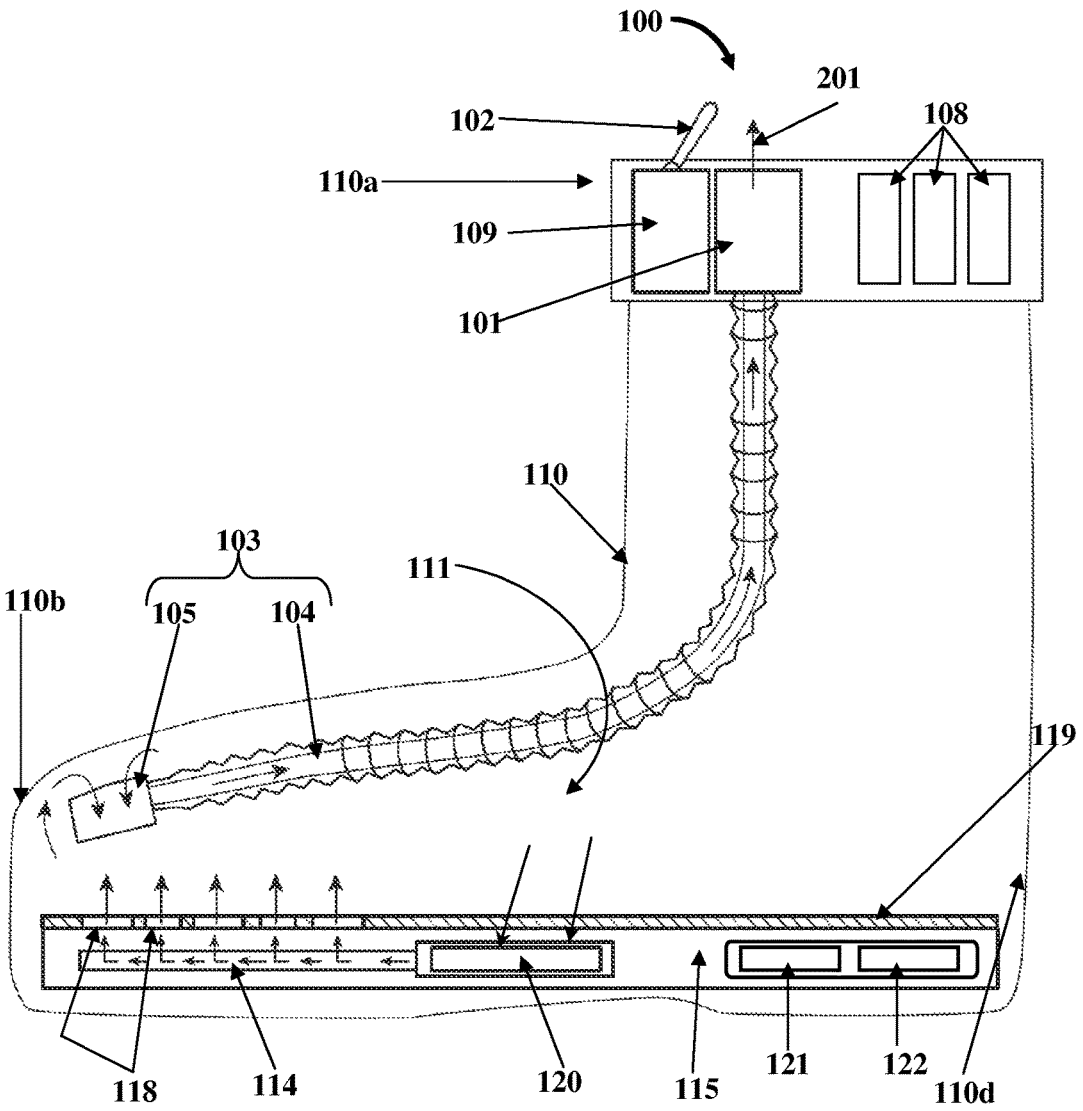
FIG. 11 exemplarily illustrates a right side elevation view of the embodiment of the ventilation apparatus shown in FIG. 8, showing the first pump in an exhaust mode and the second pump in a pump mode.

FIG. 11 exemplarily illustrates a right side elevation view of the embodiment of the ventilation apparatus 100 shown in FIG. 8, showing the first pump 101 in an exhaust mode and the second pump 120 in a pump mode. In another example, when the user wants to ventilate the cavity 111 of the footwear 110 by exhausting fluid 201, for example, air and water vapor from the cavity 111 of the footwear 110, the user activates the switching unit 102 to switch the first pump 101 to the exhaust mode and the second pump 120 to the pump mode. The first pump 101 is switched to the exhaust mode by reversing the polarity of the supplied voltage from the energy storage devices 108 via the switching unit 102. In the pump mode, the second pump 120 pumps the fluid 201 from the rear end 110*d* of the footwear 110 through the channels 116 of the fluid distribution channel member 114 and the through holes 118 on the insole 119 exemplarily illustrated in FIGS. 8-9, towards the front end 110*b* of the footwear 110 as exemplarily illustrated in FIG. 11. In the exhaust mode, the first pump 101 further suctions the fluid 201 from the cavity 111 proximal to the front end 110*b* of the footwear 110 through the openings 106 of the diffusing member 105 and the feed pipe 104 and exhausts the fluid 201 to the ambient environment external to the footwear 110.

Figure 12:
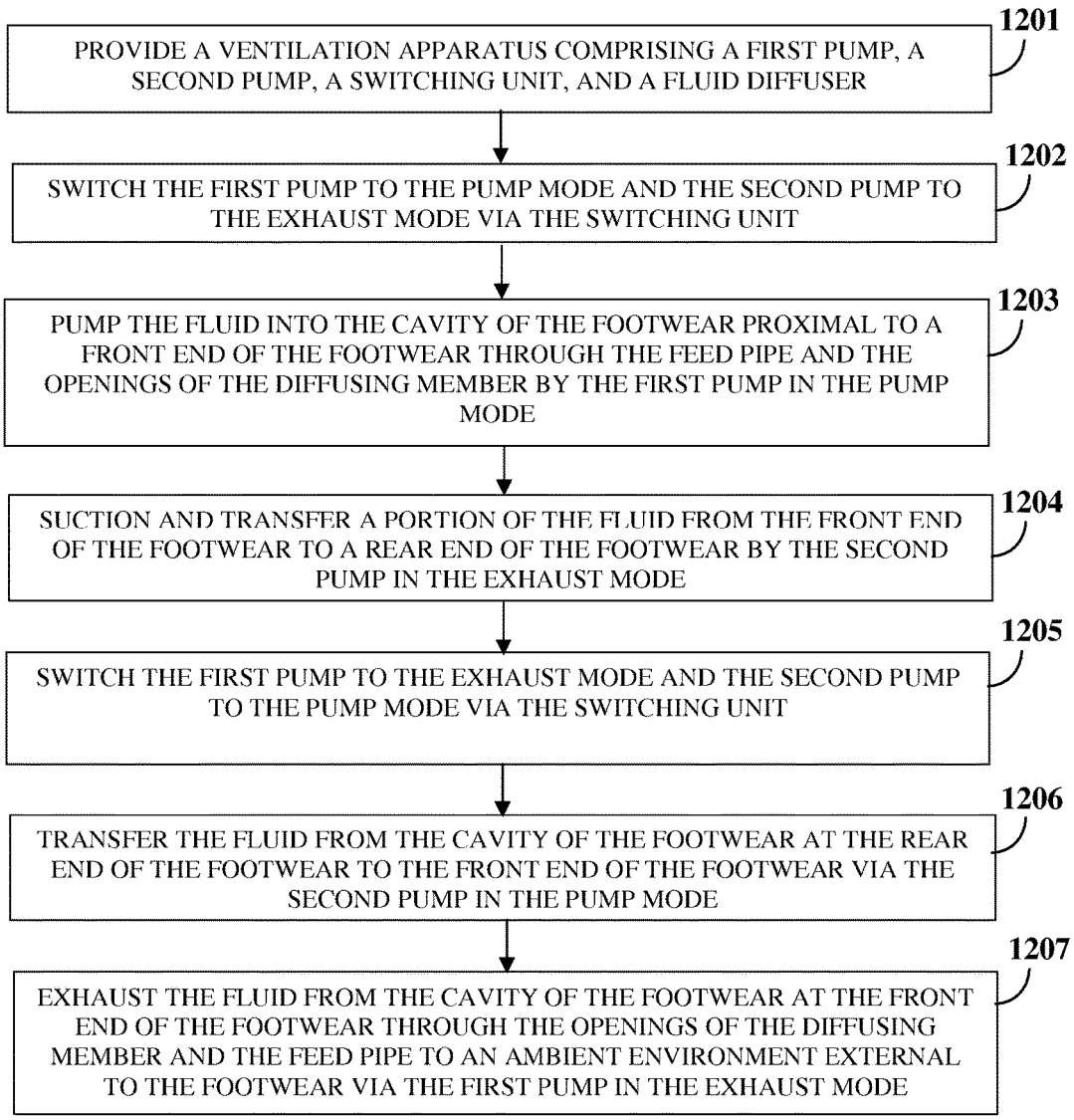
FIG. 12 exemplarily illustrates a method for ventilating footwear.

FIG. 12 exemplarily illustrates a method for ventilating footwear 110 exemplarily illustrated in FIGS. 8-9. The ventilation apparatus 100 comprising the first pump 101 and the second pump 120, the switching unit 102, and the fluid diffuser 103 as exemplarily illustrated in FIGS. 8-9, is provided 1201. The switching unit 102 switches 1202 the first pump 101 to the pump mode and the second pump 120 to the exhaust mode. The first pump 101 in the pump mode pumps 1203 the fluid 201, for example, air from the ambient environment external to the footwear 110 through the feed pipe 104 and the openings 106 of the fluid diffuser 103 into the cavity 111 of the footwear 110 proximal to the front end 110*b* of the footwear 110 as exemplarily illustrated in FIG. 10. In the embodiment, the fluid distribution channel member 114 comprising the channels 116 in fluid communication with the openings 106 of the diffusing member 105 via the through holes 118 of the insole 119 of the footwear 110 exemplarily illustrated in FIGS. 8-9, transfer the fluid 201 received from the openings 106 of the diffusing member 105 to the second pump 120. The second pump 120 in the exhaust mode suctions and transfers 1204 a portion of the fluid 201 from the front end 110*b* of the footwear 110 to a rear end 110*d* of the footwear 110. Replacing the exhausted fluid from the cavity 111 of the footwear 110 with the fluid 201, for example, air from the ambient environment ventilates the cavity 111 inside the footwear 110.

The switching unit 102 then switches 1205 the first pump 101 to the exhaust mode and the second pump 120 to the pump mode. In the pump mode, the second pump 120 transfers 1206 the fluid 201 from the cavity 111 of the footwear 110 at the rear end 110*d* of the footwear 110 to the front end 110*b* of the footwear 110 as exemplarily illustrated in FIG. 11. The channels 116 of the fluid distribution channel member 114 transfer the fluid 201 pumped by the second pump 120 to the openings 106 of the diffusing member 105 via the through holes 118 of the insole 119 of the footwear 110. In the exhaust mode, the first pump 101 exhausts 1207 the fluid 201 from the cavity 111 of the footwear 110 at the front end 110*b* of the footwear 110 through the openings 106 of the diffusing member 105 and the feed pipe 104 to an ambient environment external to the footwear 110. The first pump 101 and the second pump 120 are selectively switched to the pump mode and the exhaust mode to ventilate the footwear 110. The switching unit 102 then switches the first pump 101 and the second pump 120 to the termination mode for terminating the operation of the first pump 101 and the second pump 120.

Figure 13:
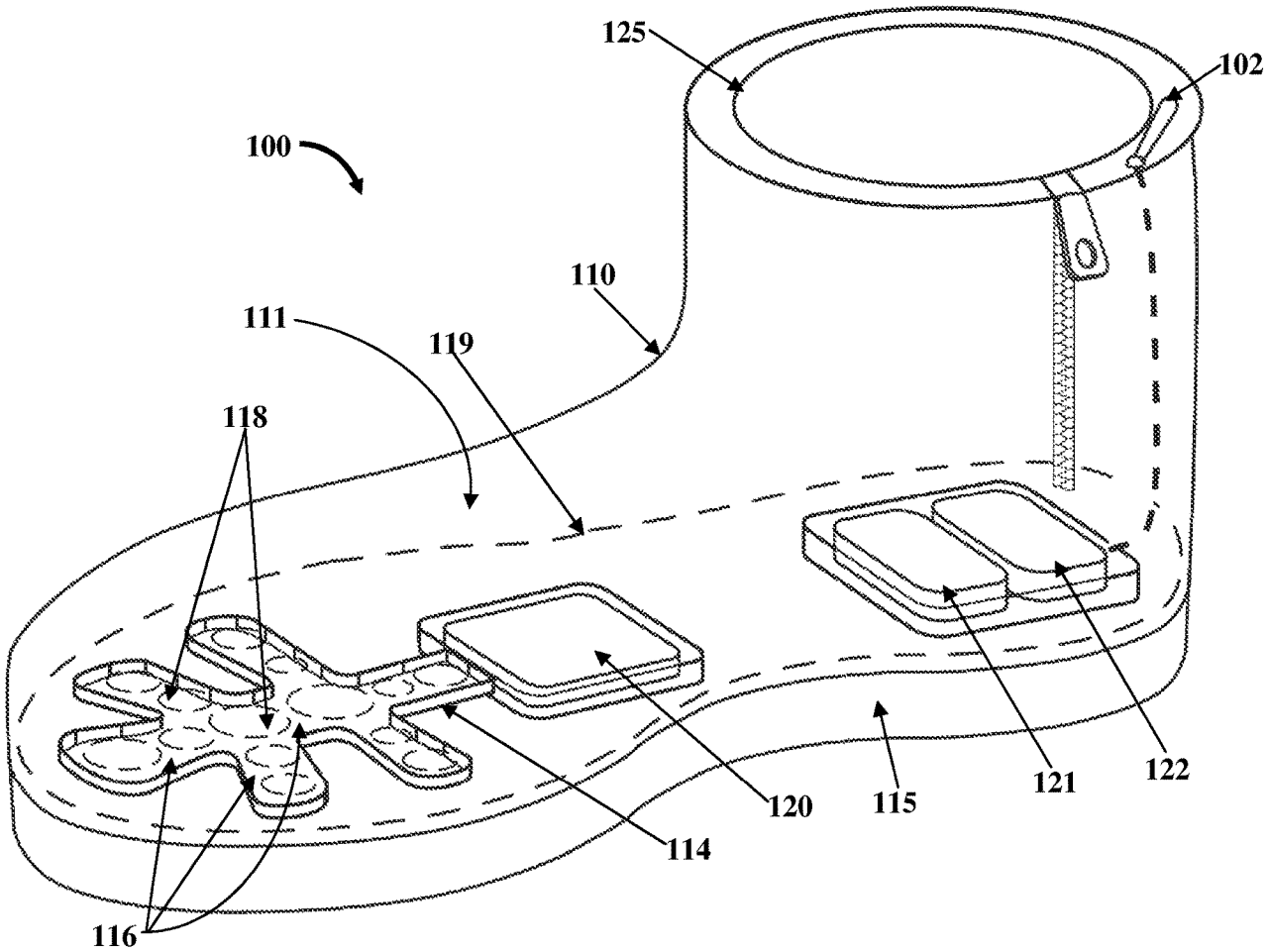
FIG. 13 exemplarily illustrates an embodiment of the ventilation apparatus for ventilating footwear with a low height.

FIG. 13 exemplarily illustrates an embodiment of the ventilation apparatus 100 for ventilating footwear 110 with a low height. In this embodiment, the ventilation apparatus 100 is configured to operate without the first pump 101, the feed pipe 104, and the diffusing member 105 exemplarily illustrated in FIG. 8. The ventilation apparatus 100 in this embodiment comprises a switching unit 102, a pump 120, the fluid distribution channel member 114 with the channels 116, the energy storage device 121, and the energy converter 122. The switching unit 102 is positioned on a collar opening 125 of the footwear 110 as exemplarily illustrated in FIG. 13. The pump 120, the fluid distribution channel member 114 with the channels 116, the energy storage device 121, and the energy converter 122 are positioned under the insole 119 of the footwear 110 inside the sole 115 of the footwear 110. The pump 120 is centrally positioned within the sole 115 of the footwear 110, while the energy storage device 121 and the energy converter 122 are positioned proximal to the rear end 110*d* of the footwear 110. The insole 119 of the footwear 110 is positioned above the sole 115 of the footwear 110 and comprises through holes 118 axially aligned with the channels 116 of the fluid distribution channel member 114. The switching unit 102 is electrically connected to the energy storage device 121 and the energy converter 122 to actuate the pump 120 in a pump mode and an exhaust mode.

During the exhaust mode, the switching unit 102 actuates the pump 120 to exhaust the fluid from the cavity 111 of the footwear 110. The exhaust fluid pumped by the pump 120 enters the channels 116 of the fluid distribution channel member 114 and exits the channels 116 through the through holes 118 of the insole 119. The fluid is further exhausted out to the ambient environment external to the footwear 110 through the collar opening 125 of the footwear 110 exemplarily illustrated in FIG. 13. During the pump mode, the pump 120 pumps the fluid from the ambient environment external to the footwear 110 in through the collar opening 125 of the footwear 110, through the channels 116 of the fluid distribution channel member 114, through the through holes 118 of the insole 119, and into the cavity 111 of the footwear 110. In this embodiment, the ventilation or cooling of a user's foot inserted into the cavity 111 of the footwear 110 is performed due to forced air movement around the foot by the pump 120.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An article of footwear with a ventilation apparatus, comprising:

said ventilation apparatus comprising a set of parts attached to said footwear, said set of parts comprising:

an electric pump disposed on an ankle section of said footwear;

a switching unit in electrical communication with said electric pump, said switching unit disposed on said ankle section of said footwear, wherein said switching unit selectively changes modes of operation of said electric pump, said modes of operation comprising:

a pump mode for pumping said fluid from an ambient environment external to said footwear into a cavity of said footwear; and an exhaust mode for exhausting said fluid from said cavity of said footwear to said ambient environment external to said footwear;

a fluid diffuser comprising:

a diffusing member positioned within said cavity of said footwear and operably connected to said electric pump in said ankle section through a feed pipe; and said feed pipe connected to and extending from said electric pump in said ankle section into said diffusing member, said feed pipe positioned within said footwear proximal to an inner surface of said footwear, wherein said feed pipe and said diffusing member transfer said fluid from said ambient environment external to said footwear to said cavity of said footwear during said pump mode, and wherein said feed pipe and said diffusing member transfer said fluid in said cavity of said footwear to said ambient environment external to said footwear during said exhaust mode for ventilating said footwear.

2. The article of footwear with the ventilation apparatus of claim 1, wherein said cavity comprises an entire interior space of said footwear, wherein said diffusing member is positioned and attached proximal to a front end of said footwear in said cavity of said footwear, and wherein said diffusing member comprises one or more openings to allow said fluid pumped from said electric pump through said feed pipe to be transferred from said ambient environment external to said footwear into said cavity of said footwear during said pump mode and to allow said fluid in said cavity of said footwear to be transferred through said feed pipe to said ambient environment external to said footwear during said exhaust mode, for ventilating said footwear.

3. The article of footwear with the ventilation apparatus of claim 1, wherein said diffusing member is a fluid distribution channel member attached within a sole of said footwear, wherein said fluid distribution channel member comprises channels in fluid communication with said feed pipe of said fluid diffuser to allow said fluid received from said feed pipe to be transferred to said cavity of said footwear during said pump mode and to allow said fluid in said cavity of said footwear to be transferred through said feed pipe to said ambient environment external to said footwear during said exhaust mode, for ventilating said footwear.

4. The article of footwear with the ventilation apparatus of claim 3, further comprising through holes on an insole of said footwear, wherein said through holes of said insole are axially aligned with said channels of said fluid distribution channel member to allow transfer of said fluid received by said channels of said fluid distribution channel member from said feed pipe to said cavity of said footwear during said pump mode and to allow transfer of said fluid from said cavity of said footwear, through said channels of said distribution channel member, into said feed pipe, and out to said ambient environment external to said footwear during said exhaust mode.

5. The article of footwear with the ventilation apparatus of claim 1, further comprising one or more energy storage devices positioned in said ankle section of said footwear and operably connected to said electric pump, wherein said one or more energy storage devices supply electrical energy to said electric pump to actuate said electric pump.

6. The article of footwear with the ventilation apparatus of claim 5, further comprising an energy converter positioned in said ankle section of said footwear and in electrical communication with said one or more energy storage devices and said electric pump, wherein said energy converter converts direct current received from said one or more energy storage devices to an alternating current to be supplied to said electric pump to actuate said electric pump.

7. The article of footwear with the ventilation apparatus of claim 1, wherein said fluid diffuser further comprises a metallic tube to enclose and secure said feed pipe, wherein said metallic tube protects said feed pipe against crumpling of said feed pipe.

8. The article of footwear with the ventilation apparatus of claim 1, wherein said modes of operation of said electric pump further comprise a termination mode for terminating said operation of said electric pump.

9. An article of footwear with a ventilation apparatus, comprising:

said ventilation apparatus comprising a set of parts attached to said footwear, said set of parts comprising:

a pair of electric pumps comprising a first electric pump disposed on an ankle section of said footwear and a second electric pump positioned within a sole of said footwear;

a pair of switching units in electrical communication with said first electric pump and said second electric pump, wherein a first switching unit of said pair of switching units is disposed on said ankle section of said footwear, wherein a second switching unit of said pair of switching units is positioned within said sole of said footwear, wherein said pair of switching units selectively change modes of operation of said first electric pump and said second electric pump, said modes of operation comprising a pump mode and an exhaust mode; and a fluid diffuser operably connected to said first electric pump in said ankle section and said second electric pump within a cavity of said footwear, said fluid diffuser comprising:

a feed pipe fixedly connected to and extending from said first electric pump in said ankle section into a diffusing member inserted within said cavity of said footwear, said feed pipe positioned within said footwear proximal to an inner surface of said footwear, wherein said feed pipe transfers said fluid pumped from said first electric pump in said ankle section to said diffusing member in fluid communication with said feed pipe; and said diffusing member positioned and attached proximal to a front end of said footwear within said cavity of said footwear, said diffusing member comprising one or more openings to allow said fluid pumped from said first electric pump in said ankle section through said feed pipe to be transferred into said cavity of said footwear proximal to said front end of said footwear and to allow said fluid in said cavity of said footwear at said rear end of said footwear to be transferred via said second electric pump and through said feed pipe to an ambient environment external to said footwear, for ventilating said footwear.

10. The article of footwear with the ventilation apparatus of claim 9, wherein said cavity comprises an entire interior space of said footwear, wherein said fluid diffuser further comprises a fluid distribution channel member attached within said sole of said footwear and operably connected to and in fluid communication with said second electric pump within said sole of said footwear, wherein said fluid distribution channel member comprises channels in fluid communication with said one or more openings of said diffusing member to allow said fluid received from said one or more openings of said diffusing member to be transferred to said second electric pump, and to allow said fluid pumped by said second electric pump to be transferred to said one or more openings of said diffusing member, into said feed pipe, and out to said ambient environment external to said footwear via said first electric pump, for ventilating said footwear.

11. The article of footwear with the ventilation apparatus of claim 10, further comprising through holes on an insole of said footwear, wherein said through holes of said insole are axially aligned with said channels of said fluid distribution channel member to allow transfer of said fluid received from said one or more openings of said diffusing member to said channels of said fluid distribution channel member for said transfer of said fluid to said second electric pump, and to allow said transfer of said fluid pumped by said second electric pump to said one or more openings of said diffusing member via said channels of said fluid distribution channel member, into said feed pipe, and out to said ambient environment external to said footwear.

12. The article of footwear with the ventilation apparatus of claim 9, further comprising a pair of energy storage devices, wherein a first energy storage device of said pair of energy storage devices is attached to said ankle section of said footwear, wherein a second energy storage device of said pair of energy storage devices is placed within a sole of said footwear, and wherein said pair of energy storage devices supply electrical energy to said pair of electric pumps to actuate said electric pumps.

13. The article of footwear with the ventilation apparatus of claim 12, further comprising a pair of energy converters in electrical communication with said pair of energy storage devices and said pair of electric pumps, wherein a first energy converter of said pair of energy converters is attached to said ankle section of said footwear, wherein a second energy converter of said pair of energy converters is placed within a sole of said footwear, wherein said pair of energy converters convert direct current received from said pair of energy storage devices to an alternating current to be supplied to said pair of electric pumps to actuate said electric pumps.

14. The article of footwear with the ventilation apparatus of claim 9, wherein said modes of operation of said first electric pump and said second electric pump further comprise a termination mode for terminating said operation of said first electric pump and said second electric pump.

* * * * *